United States Patent [19]

Watanabe

[11] Patent Number: 5,025,429

[45] Date of Patent: Jun. 18, 1991

[54] ELECTRIC POWER SUPPLY DEVICE FOR HAND WITH LOAD

[75] Inventor: Isato Watanabe, Tokyo, Japan

[73] Assignee: Seikosha Co., Ltd., Japan

[21] Appl. No.: 458,917

[22] Filed: Dec. 29, 1989

[30] Foreign Application Priority Data

Dec. 29, 1988 [JP] Japan ..... 63-331196

[51] Int. Cl.[5] ..... G04B 19/02

[52] U.S. Cl. ..... 368/238; 368/204

[58] Field of Search ..... 368/238, 201

[56] References Cited

U.S. PATENT DOCUMENTS 347,528 8/1886 Speer .

FOREIGN PATENT DOCUMENTS 827771 1/1952 Fed. Rep. of Germany .
418605 10/1934 United Kingdom .
664871 1/1952 United Kingdom .

*Primary Examiner*—Bernard Roskoski
*Attorney, Agent, or Firm*—Bruce L. Adams; Van C. Wilks

[57] ABSTRACT

A timepiece has rotatable hour, minute and second hands each carrying an energizeable element. Electric power is supplied to the elements carried by the hour and minute hands through sliding contacts and is supplied to the element carried by the second hand through electromagnetically coupled coils. The drive torque applied to the hour and minute hands is greater than that applied to the second hand and easily overcomes the frictional drag associated with the sliding contacts. The lower drive torque applied to the second hand may not be sufficient to overcome the frictional drag associated with sliding contacts and to avoid this problem, electromagnetically coupled coils instead of sliding contacts are used to supply electric power to the element carried by the second hand.

15 Claims, 2 Drawing Sheets

ELECTRIC POWER SUPPLY DEVICE FOR HAND WITH LOAD

BACKGROUND OF THE INVENTION

The present invention relates to an electric power supply device for a hand or pointer which carries an electric load.

The present applicant has proposed an electric power supply device for a hand with load or pointer with load in U.S. patent application Ser. No. 407,408. This device is constructed as described below.

Two annular conductors are disposed around the center of rotation of a hand or pointer below the hand. A pair of contact members each of which has a contact capable of sliding on one of the annular conductors is mounted on the underside of the hand. The annular conductors are electrically connected with an external circuit. The contact members are electrically connected with a load on the hand.

In operation, when electric power is supplied to the two annular conductors from the external circuit, the two contact members are electrically connected by the contacts sliding on the annular conductors. Then, electric power is supplied to the load.

In the aforementioned prior art structure, when the contacts slide on the annular conductors, they produce resistance to the rotation of the hand. If the pressure applied to the conductors by the contacts is reduced to decrease the resistance, then the reliability of the electrical conduction may be deteriorated. Therefore, it is necessary to take care in machining and assembling the contacts. Also, it is cumbersome to execute these operations. Further, it is necessary to mount the contacts to the hand in such a way that they are placed in a predefined position. In this way, it is laborious and cumbersome to manufacture hands or pointers.

SUMMARY OF THE INVENTION

Accordingly, it is an object of the present invention to provide an electric power supply device which is used for a hand with load, easy to manufacture, does not affect the torque applied to the hand, and permits electrical conduction with high reliability.

The present invention is characterized by the provision of a first coil mounted on the underside of a hand around the center of rotation of the hand, a second coil disposed opposite and close to the first coil and below the hand and supplied with electric power from an external power supply, and a load placed on the hand and electrically connected with the first coil.

In accordance with the present invention, the second coil disposed below the hand is electrically connected with the external circuit. Electric current flows through the second coil, producing magnetic flux around it. Since alternating current flows through the second coil, the magnetic flux constantly changes. The variations in the magnetic flux produce a voltage across the first coil mounted close to the second coil thereby generating electric current. Because of the action of the electromagnetic induction, electric power is supplied to the first coil on the underside of the hand from the second coil connected with the external circuit. Then the electric power is supplied to the load connected to the first coil.

DETAILED DESCRIPTION OF THE INVENTION

Figure 1:
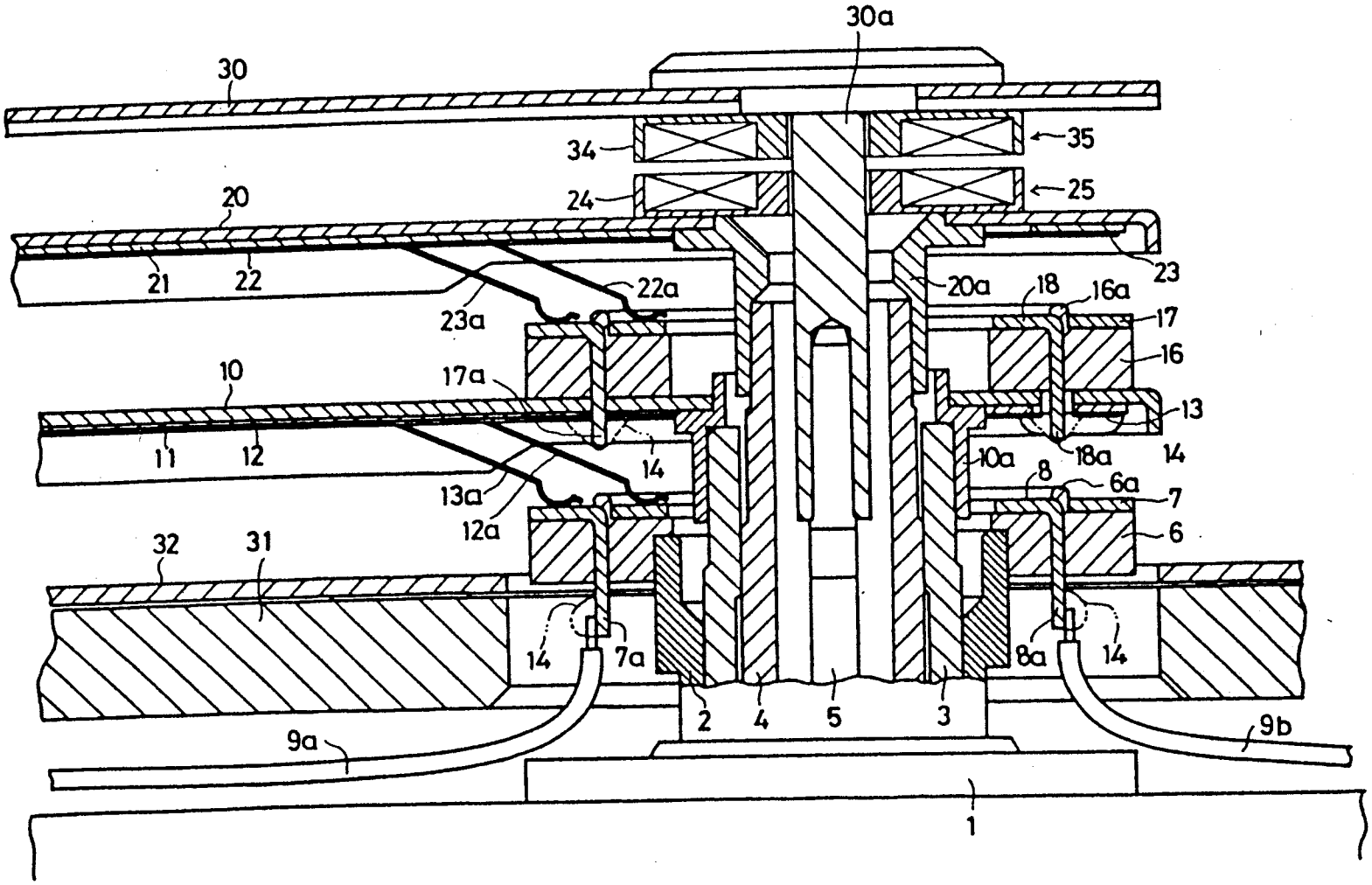
FIG. 1 is a cross-sectional view of main portions of a timepiece equipped with an electric power supply device according to the invention.

One example of the invention is now described by referring to the drawings.

The timepiece has an hour hand and a minute hand supplied with electric power in the same manner as the prior art construction. The second hand of the timepiece is supplied with electric power from an electric power supply device according to the present invention.

Referring to FIG. 1, a bush 2 is rigidly fixed to a timepiece movement 1. An hour hand shaft 3, a minute hand shaft 4, and a second hand shaft 5 extend through the bush 2. A fixed receiver 6 is pressed into the upper end portion of the bush 2. An annular protrusion 6*a* protrudes from the upper surface of the fixed receiver 6 around the center of rotation of the hands. An annular fixed conductor 7 is disposed outside the protrusion 6*a*. Another annular fixed conductor 8 is located inside the protrusion 6*a*. Portions of the conductors 7 and 8 are bent to form L-shaped connecting members 7*a* and 8*a*, respectively. These connecting members 7*a* and 8*a* protrude below the fixed receiver 6 and are connected with lead wires 9*a* and 9*b*, respectively, so that the members 7*a*, 8*a* are electrically connected with a driver circuit (not shown).

A time-indicating member comprised of an hour hand 10 rigidly fixed to the hour hand shaft 3 is located above the fixed receiver 6. An insulating plate 11 on which a pair of conductors 12, 13 is mounted is firmly fixed to the underside of the hour hand 10. The conductors 12 and 13 act to supply electric power to an electroluminescent device $EL_1$ (see FIG. 2) mounted on the hour hand 10. The conductors 12 and 13 have contacts 12*a* and 13*a*, respectively, which rotate around the center of rotation of the hour hand 10 and slide on the annular fixed conductors 7 and 8, respectively.

A receiver 16 of the same structure as the fixed receiver 6 is rigidly fixed to the upper surface of the hour hand 10. An annular conductor 17 is disposed outside the protrusion on the receiver 16. Another annular conductor 18 is disposed inside the protrusion 16*a* on the receiver 16. The conductors 17 and 18 have L-shaped connecting members 17*a* and 18*a* extend through the receiver 16 and protrude below the hour hand 10. The connecting members 17*a* and 18*a* which are soldered at 14 to the conductors 12 and 13, respectively.

A time-indicating member comprised of a minute hand 20 rigidly fixed to the minute hand shaft 4 is located above the hour hand 10. A pair of conductors 22 and 23 similar in structure to the conductors 12 and 13 is mounted on an insulating plate 21 which is rigidly fixed to the underside of the minute hand 20. The conductors 22 and 23 supply electric power to an electroluminescent device $EL_2$ (see FIG. 2) mounted on the minute hand 20. The conductors 22 and 23 have contacts 22*a* and 23*a*, respectively, which can slide on the annular conductors 17 and 18 on the hour hand 10.

A second coil bobbin 24 made from a magnetic material is rigidly fixed to the upper surface of the minute hand 20 around the center of rotation of the minute hand 20. A conductive wire is wound on the second coil bobbin 24 to form a second coil 25 that is electrically connected with the conductors 22 and 23.

A time-indicating member comprised of a second hand 30 rigidly fixed to the second hand shaft 5 is disposed above the minute hand 20. A first coil bobbin 34 made from a magnetic material is rigidly fixed to the underside of the second hand 30 around the center of rotation of the second hand 30. The first coil bobbin 34 is opposite and close to the second coil bobbin 24. A conductive wire is wound on the first coil bobbin 34 to form a first coil 35 that is electrically connected with an electroluminescent device $EL_3$ (see FIG. 2) mounted on the second hand 30.

The hour hand 10, the minute hand 20, and the second hand 30 are rigidly fixed to the hour hand shaft 3, the minute hand shaft 4, and the second minute shaft 5 via sleeves 10*a*, 20*a*, and a pipe 30*a*, respectively. These hands can rotate above a dial 32 fixed to a dial receiver 31.

In the timepiece described thus far, the hour hand 10, the minute hand 20, and the second hand 30 are rotated by the timepiece movement 1 to indicate the time. Electric power from the driver circuit is fed to the annular fixed conductors 7, 8 from the lead wires 9*a*, 9*b*. Then, it is supplied to the contact members 12, 13 via the contacts 12*a* and 13*a* sliding on the annular fixed conductors 7 and 8, respectively. Finally, the power is furnished to the electroluminescent device $EL_1$ that is a load on the hour hand 10.

Similarly electric power is supplied to the electroluminescent device $EL_2$ that is a load on the minute hand 20, via the conductors 12, 13, the annular conductors 17, 18, and the conductors 22, 23 in the same manner.

At this time, electric power is supplied to the second coil 25 from the conductors 22, 23. As a result, electric power is induced across the first coil 35. Then, electric power is supplied to the electrolumiscent device $EL_3$ that is a load on the second hand 30, by a connecting means (not shown).

Figure 2:
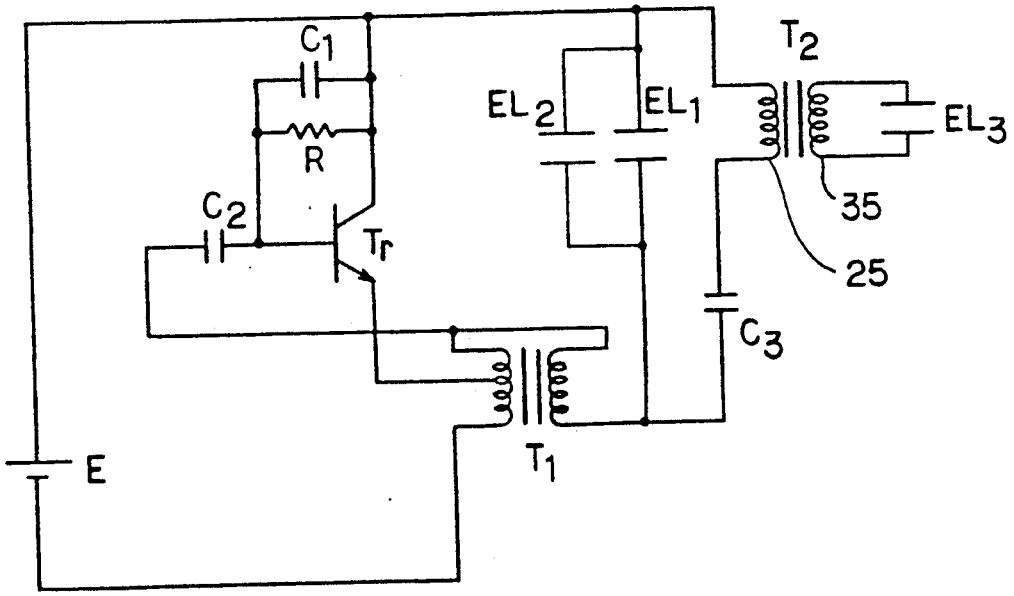
FIG. 2 is an electrical circuit diagram of a part of the timepiece.

The electrical operation of the inventive electric power supply device is next described by referring to FIG. 2.

In the present example, the electroluminescent devices $EL_1$–$EL_3$ are mounted on the hands as loads. When an AC voltage is applied to each electroluminescent device, it emits light and so it is a kind of capacitor.

The driver circuit for the electroluminescent devices $EL_1$–$EL_3$ comprises capacitors $C_1$, $C_2$, a resistor R, a transformer $T_1$, a transistor $T_r$, and the electroluminescent devices $EL_1$ and $EL_2$ to form a blocking oscillator which transforms the voltage from a DC voltage source E into an AC voltage to drive the electroluminescent devices $EL_1$ and $EL_2$. A capacitor $C_3$ stabilizes the oscillation.

In the present example, the second coil 25 connected with the electroluminescent devices $EL_1$ and $EL_2$, and the first coil 35 which is electromagnetically coupled to the second coil 25 form a second transformer $T_2$. The coil 25 comprises the transformer primary and the coil 35 comprises the transformer secondary. When alternating current flows through the second coil 25, electric power is induced across the first coil 35 by electromagnetic induction. Therefore, electric power is supplied to the electroluminescent device $EL_3$ on the second hand 30.

In the present example, electric power is supplied to the hour hand 10 and the minute hand 20 by a conventional electric power supply device. Only the second hand 30 is supplied with electric power by the novel electric power supply device. It is also possible to use novel power supply devices for the hour hand 10 and for the minute hand 20.

The first coil 35 or the second coil 25 can be made of a self-fusing wire. Further, it can be an air-core coil having neither the first coil bobbin 34 nor the second coil bobbin 24. Additionally, the first coil bobbin 34 and the second coil bobbin 24 can be made from a nonmagnetic material.

Loads can take various forms such as LEDs, as well as the electroluminescent devices $EL_1$–$EL_3$.

As described thus far, in accordance with the present invention, electric power can be supplied to timepiece hands with loads in a noncontact manner. Therefore, the torques acting on the hands are not affected. Accordingly, the invention can be applied to hands driven with low torque, such as a timepiece second hand. Further, electrical conduction is reliable. Additionally, works such as machining and mounting operations are easy to perform, and accuracy is not required. Moreover, the assembly is easy to carry out.

I claim:

1. In a timepiece having hour, minute and second hands each having a drivable load, an electric power supply device comprising:

a fixed contact receiver disposed below the hour hand and having two fixed annular conductors on the upper side of the fixed contact receiver concentrically with the center of rotation of the hands, a contact receiver secured on the upper side of the hour hand and having two other annular conductors on the upper side of the contact receiver concentrically with the center of rotation of the hands, a pair of first contact members for supplying electric drive power to the load mounted on the hour hand, the first contact members being disposed on the under side of the hour hand and having respective contact segments slidable on each of the fixed annular conductors, a pair of second contact members for supplying electric drive power to the load mounted on the under side of the minute hand and having respective contact segments slidable on each of the other annular conductors, a first coil mounted on the under side of the second hand concentrically with the center of rotation of the hands, and a second coil mounted on the upper side of the minute hand opposite and close to the first coil, wherein the fixed annular conductors are supplied with electric power from an external power supply, the other annular conductors are connected electrically with the pair of first contact members, the second coil is connected electrically with the pair of second contact members and the first coil is connected electrically with the load on the second hand.

2. An electric power supply device according to claim 1; wherein the first coil is wound on a first coil bobbin rigidly fixed to the under side of the second hand, and the second coil is wound on a second coil bobbin rigidly fixed to the upper side of the minute hand.

3. An electric power supply device according to claim 2; wherein the first and second coil bobbins are made from a magnetic material.

4. An electric power supply device according to claim 1; wherein the load on the second hand comprises an electroluminescent device.

5. An electric power supply device according to claim 1; wherein the load on the second hand comprises an LED.

6. An electric power supply device according to claim 1; wherein each of the first and second coil is made of a self-fusing wire.

7. In a timepiece having at least two rotationally driven time-indicating members for indicating time: an electrically energizeable device carried by each of at least two of the time-indicating members; and circuit means for supplying electric power to the energizeable devices, the circuit means comprising a set of slidable contacts connected to one of the two time-indicating members for movement therewith and electrically connected to the energizeable device carried thereby, means for supplying electrical power to the slidable contacts, a primary coil mounted on the one time-indicating member and electrically connected to the slidable contacts whereby electric power supplied to the slidable contacts effects current flow through the primary coil, and a secondary coil mounted on the other of the two time-indicating members and electrically connected to the energizeable device carried thereby, the secondary coil being closely spaced and electromagnetically coupled directly to the primary coil such that current flow in the primary coil induces current flow in the secondary coil to energize the energizeable device carried by the other time-indicating member.

8. A timepiece according to claim 7, wherein at least one of the energizeable devices comprises an electroluminescent element.

9. A timepiece according to claim 7; wherein at least one of the energizeable devices comprises a light-emitting diode.

10. A timepiece according to claim 7; wherein the primary coil is wound on a first bobbin connected to the one time-indicating member, and the secondary coil is wound on a second bobbin connected to the other time-indicating member.

11. A timepiece according to claim 7; wherein the first and second bobbins are composed of a magnetic material.

12. A timepiece according to claim 7; wherein the primary and secondary coils are comprised of self-fusing wire.

13. A timepiece according to claim 7; wherein the other time-indicating member comprises a second indicator for indicating second time.

14. A timepiece according to claim 13; wherein the energizeable device carried by the second indicator comprises an electroluminescent element.

15. A timepiece according to claim 13; wherein the energizeable device carried by the second indicator comprises a light-emitting diode.

* * * * *